US008671464B2

(12) United States Patent
Silverberg

(10) Patent No.: US 8,671,464 B2
(45) Date of Patent: Mar. 18, 2014

(54) TEMPERATURE REGULATING GARMENT

(76) Inventor: Mark Silverberg, Riverwoods, IL (US)

( * ) Notice: Subject to any disclaimer, the term of this patent is extended or adjusted under 35 U.S.C. 154(b) by 280 days.

(21) Appl. No.: 13/024,635

(22) Filed: Feb. 10, 2011

(65) Prior Publication Data

US 2011/0302703 A1 Dec. 15, 2011

Related U.S. Application Data

(60) Provisional application No. 61/353,442, filed on Jun. 10, 2010.

(51) Int. Cl.
*A41D 13/005* (2006.01)
*A41D 27/20* (2006.01)

(52) U.S. Cl.
USPC ..... 2/69; 2/94; 2/247; 2/253

(58) Field of Classification Search
USPC ..... 2/94, 102, 108, 253, 458, 467, 69, 85, 2/93, 92, 115, 254, 79, 114, 51, 247–250, 2/7, 97, 81; 607/108, 109, 111, 112; 219/211; 62/259.3
See application file for complete search history.

(56) References Cited

U.S. PATENT DOCUMENTS

| | | | | | |
|---|---|---|---|---|---|
| 139,950 | A | * | 6/1873 | Garaud | 2/94 |
| 992,376 | A | * | 5/1911 | Moore | 2/467 |
| 1,088,891 | A | * | 3/1914 | Filson | 2/115 |
| 2,322,510 | A | * | 6/1943 | Dufine | 2/97 |
| 2,331,962 | A | * | 10/1943 | Collins | 2/92 |
| 2,403,676 | A | * | 7/1946 | Modlinski | 2/94 |
| 3,047,877 | A | * | 8/1962 | Palazzo | 2/94 |
| 3,950,789 | A | * | 4/1976 | Konz et al. | 2/93 |
| 4,637,075 | A | * | 1/1987 | Ingrisano et al. | 2/94 |
| 4,791,681 | A | * | 12/1988 | Dean | 2/106 |
| 5,031,244 | A | * | 7/1991 | Inagaki | 2/102 |
| 5,038,779 | A | * | 8/1991 | Barry et al. | 607/108 |
| 5,146,625 | A | | 9/1992 | Steele et al. | |
| 5,218,720 | A | * | 6/1993 | Tolton | 2/97 |
| 5,302,806 | A | | 4/1994 | Simmons et al. | |
| 5,305,471 | A | | 4/1994 | Steele et al. | |
| 5,484,448 | A | | 1/1996 | Steele et al. | |
| 5,605,144 | A | | 2/1997 | Simmons et al. | |
| 5,652,961 | A | * | 8/1997 | Knight-Yurt | 2/114 |
| 5,694,646 | A | * | 12/1997 | Roberts | 2/114 |
| 5,718,000 | A | * | 2/1998 | Ost et al. | 2/69 |
| 5,787,505 | A | | 8/1998 | Piwko et al. | |
| 5,826,273 | A | * | 10/1998 | Eckes | 2/69 |
| 6,692,413 | B1 | * | 2/2004 | Greenberg et al. | 482/105 |
| 6,763,527 | B1 | * | 7/2004 | Rivoli et al. | 2/250 |
| 6,931,875 | B1 | | 8/2005 | Allen et al. | |

(Continued)

FOREIGN PATENT DOCUMENTS

| | | |
|---|---|---|
| AU | 2005100085 | 3/2005 |
| CA | 2214328 | 4/1999 |
| DE | 20219895 | 4/2003 |
| WO | 2005/006896 | 1/2005 |

*Primary Examiner* — Amy Vanatta
(74) *Attorney, Agent, or Firm* — Greer, Burns & Crain, Ltd.

(57) ABSTRACT

A garment for regulating temperature includes a body having a back panel and at least one front panel made of a temperature insulating textile and partially joined along at least one common edge, the joined panels defining an inside chamber. At least one pocket is fastened to an inside surface of at least one of the front panel and the back panel. The at least one pocket is configured for accommodating a temperature regulating element.

18 Claims, 3 Drawing Sheets

(56) References Cited

U.S. PATENT DOCUMENTS

| | | | | |
|---|---|---|---|---|
| 7,216,370 | B1 * | 5/2007 | Warner et al. | 2/23 |
| 7,816,628 | B2 | 10/2010 | Fernandez et al. | |
| D657,939 | S * | 4/2012 | Mathews | D2/847 |
| 2006/0253954 | A1 * | 11/2006 | Music | 2/115 |
| 2008/0201818 | A1 * | 8/2008 | Nilforushan et al. | 2/69 |
| 2009/0217440 | A1 | 9/2009 | Sutker | |
| 2009/0289046 | A1 * | 11/2009 | Richmond | 219/211 |
| 2011/0041229 | A1 * | 2/2011 | Niemi et al. | 2/69 |

* cited by examiner

TEMPERATURE REGULATING GARMENT

RELATED APPLICATION

This application claims priority pursuant to 35 USC 119 from U.S. Provisional Application Ser. No. 61/353,442 filed Jun. 10, 2010.

BACKGROUND

This invention relates generally to clothing, and more specifically to garments worn by medical personnel in operating rooms.

To create a proper working environment, medical operating rooms are usually maintained at a certain temperature which is often relatively cold to offset hot lighting, to keep stressed doctors and nurses comfortable while working, and/or to inhibit the spread of bacteria. In most hospitals, medical personnel are forbidden from bringing street clothing into the operating room. In some cases, anesthesiologists, nurses and any other personnel in the operating room who are not scrubbed in may wear a medical or hospital issue warm up jacket over their scrubs; however, these garments do not keep the wearer at a comfortable temperature. Excessive layers of garments are also counterproductive in the operating room, since they may restrict the mobility or dexterity of the personnel. On the other hand, limbs and fingers tend to get stiff when the body is cold.

Anesthesiologists, nurse anesthetists, perioperative nurses, and others participating in the operating room need their body to be at a comfortable level of temperature and dexterity to perform their functions over many hours. Additionally, medical personnel suffering from hormonal changes often have abnormal body temperature perceptions while participating in surgery. One example is post menopausal women, who suffer from periodic drastic perceived changes in body temperature and often feel much warmer than other individuals in the same room. Also, the surgical treatment of burn patients or pediatric patients usually requires the operating or treating room to be warmer than average for the patient's benefit. The latter situation requires alternative measures for keeping medical personnel comfortable.

SUMMARY

The above-listed needs are met or exceeded by the present invention, which features a garment configured for keeping operating room personnel at a desired temperature. A specially designed warm up jacket is provided to be worn over scrubs. A version of the present garment is a specially designed vest provided to be worn over scrubs and under any sort of warm up jacket or surgical gown. In a preferred embodiment, the garment is made of a thermally insulating material, such as GORE® surgical fabric, preferably level 3 or 4. Furthermore, the present garment features at least one and preferably several pockets which are designed to releasably accommodate a temperature element such as a reusable heatable gel pack or chemical warming pack, cooling pack or the like.

It is contemplated that the size and locations of the temperature regulating elements are variable to suit the situation. The temperature regulating element can be a heating element, such as a chemical warming pack, reusable heated gel pack or warmed up bag of IV fluid, or a cooling element, such as a chemical cooling pack, reusable cooled gel pack, refrigerated bag of IV fluid or ice packs. While preferably made of mesh material, the pockets are designed to allow the heat generated by the regulating elements to be distributed generally uniformly throughout an inside chamber defined by the present garment. The garment also features at least one single layer pocket, designed to hold a heating or cooling pack over the wearer's lumbar region. When provided as a vest, the present garment can be reversed to provide an additional layer of nonfenestrated material between the wearer and the temperature element. Such an additional layer is helpful when a cooling element is used to prevent the discomfort of localized cold upon the skin.

More specifically, a garment is provided for regulating temperature and includes a body having a back panel and at least one front panel made of a temperature insulating textile and partially joined along at least one common edge, the joined panels defining an inside chamber. At least one pocket is fastened to an inside surface of at least one of the front panel and the back panel. Additionally, at least one pocket is configured for accommodating a temperature regulating element.

In another embodiment, a garment is provided for regulating temperature and includes a body having a back panel and at least one front panel made of a temperature insulating textile and partially joined along at least one common edge, the joined panels defining an inside chamber. At least one pocket is fastened to an inside surface of at least one of the front panel and the back panel. Additionally, at least one pocket is configured for accommodating a temperature regulating element. At least one temperature regulating element is disposed inside one or more of the pockets, each temperature regulating element being configured for maintaining a desired temperature within the inside chamber.

DETAILED DESCRIPTION

Figure 1:
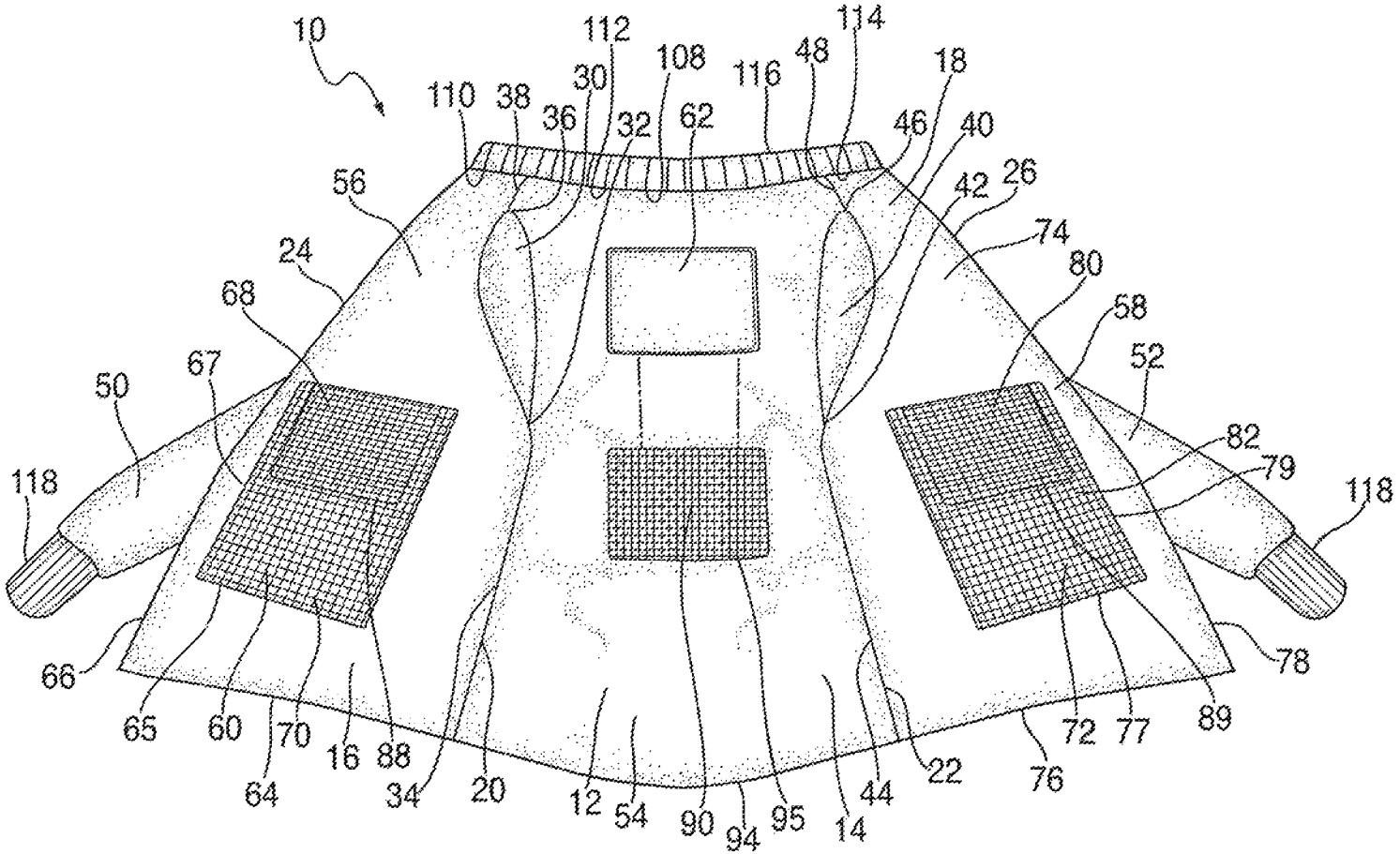
FIG. 1 is a front view of the present temperature regulating garment shown in an open position with a temperature regulating element exploded out.
Figure 2:
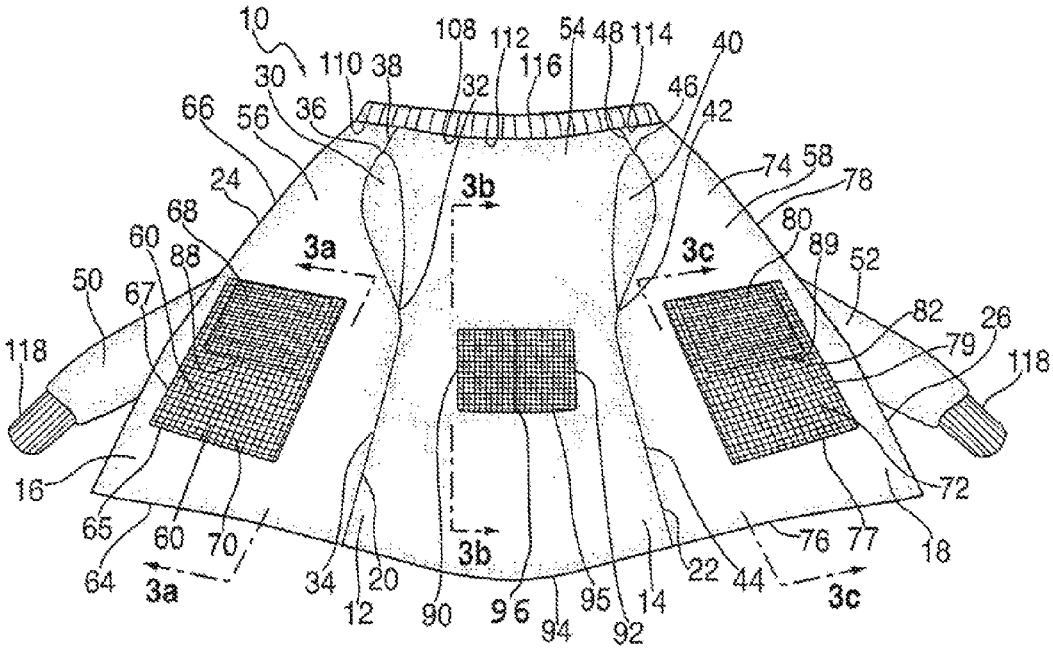
FIG. 2 is front view of the garment of FIG. 1 shown without the temperature regulating element.
Figure 4:
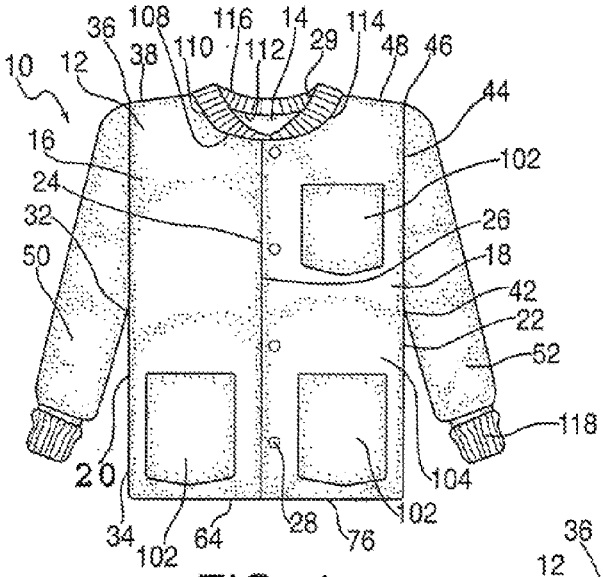
FIG. 4 is a front view of the present garment.

Referring to FIGS. 1-2 and 4, a garment for regulating temperature is generally designated 10, and in the preferred embodiment is a jacket including a body 12 with a back panel 14, at least one of a first front panel 16 and a second front panel 18. The first front panel 16 is partially joined along at least one first common edge 20 shared with the back panel 14. Likewise, the second front panel 18 is partially joined along at least one second common edge 22 shared with the back panel 14. As is known in the art, the common edges 20, 22 form seams. The first front panel 16 and the second front panel 18 are joinable along respective free edges 24, 26, preferably by fasteners 28, such as snaps, buttons, clips, zippers, VELCRO® hook and loop fastener material, and the like. Upon assembly, the joined panels 14, 16 and 18 combine to define an inside chamber 29.

A first arm hole 30 is defined in part by an end 32 of a seam 34 formed by joining the common edges 20 of the first front panel 16 and the back panel 14, and at an end 36 of the arm hole opposite the end 32 by a shoulder seam 38 formed by a junction of the first front panel 16 and the back panel 14. Likewise, a second arm hole 40 is defined by an end 42 of a second seam 44 formed by joining the common edges 22 of the second front panel 18 and the back panel 14, and at an end 46 of the arm hole 40 opposite the end 42 by a shoulder seam 48 formed by a junction of the second front panel 18 and the back panel 14.

A first sleeve 50 and a second sleeve 52 are optionally affixed respectively to the first and second arm holes 30, 40. Preferably, the body 12, and if provided, the sleeves, 50, 52 of the garment 10 are made of GORE® surgical fabric, level 3 or 4, but alternate embodiments are contemplated where the body is made of any thermally insulating, synthetic, non-linting medically acceptable textile, including, but not limited to polyester fabric, nylon or the like.

Referring now to FIG. 1, the garment 10 is depicted in an open position such that an inner surface 54 of the back panel 14, an inner surface 56 of the first front panel 16, and an inner surface 58 of the second front panel 18 are shown. A first pocket 60 dimensioned for accommodating a temperature regulating element 62 is fastened to the inner or interior surface 56 of the first front panel 16 approximately 10-15 centimeters from a bottom edge or hem 64 of the first front panel to a bottom edge 65 of the pocket and approximately 4 centimeters from a side edge 66 of the first front panel 16 to an adjacent pocket edge 67. A third pocket 68, preferably smaller than the first pocket 60, is fastened to an outer or exterior surface 70 of the first pocket 60. As an alternative, the third pocket 68, is directly fastened to the inner surface 56 of the first front panel 16, and therefore will lie inside the first pocket 60.

Likewise, a second pocket 72 dimensioned for accommodating the temperature regulating element 62 is fastened to an inner surface 58 of the second front panel 18 approximately 10-15 centimeters from a bottom edge or hem 76 of the second front panel 18 to a bottom pocket edge 77 and approximately 4 centimeters from a side edge 78 of the second front panel 18 to an adjacent pocket edge 79. A fourth pocket 80, preferably smaller than the second pocket 72, is fastened to an outer or exterior surface 82 of the second pocket 72. As an alternative, a fourth pocket 80, is directly fastened to the inner surface 58 of the second front panel 18, and therefore will lie inside the second pocket 72. The preferred dimension of the first and the second pockets 60, 72 is 25 cm deep or tall, and 20 cm wide. These pockets 60, 72 are sized to accommodate a larger temperature regulating element 62, including but not limited to IV fluid bags, but may also hold a smaller temperature regulating element such as a chemical warming pack. The preferred dimensions of the third and fourth pockets 68, 80 are 12 cm deep or tall and 16 cm wide. The bottom edge 65 of the first pocket 60 and the bottom edge 77 of the second pocket 72 are preferably located 13 cm from bottom edges 88, 89 of the third and fourth pockets 68, 80, respectively. These pockets 68, 80 are sized to accommodate a smaller temperature regulating element 62, such as a chemical warming pack. For the purposes of this application, the above-identified combinations of the first and third pockets 60 and 68, and the second and fourth pockets 72 and 80 will also be referred to as double pockets.

Referring now to FIG. 2, a fifth pocket 90 and a sixth pocket 92 for accommodating a temperature regulating element 62 are fastened to the inner surface 54 of the back panel 14 approximately 20-25 cm from a bottom edge 94 of the back panel to a bottom edge 95 of the pockets. Advantageously, the fifth and sixth pockets 90, 92 are placed over a wearer's lumbar region to direct the temperature regulating element 62 over this body region. Accordingly, the preferred dimension of each of the fifth and sixth pockets 90, 92 is 12-25 cm deep or tall and 16-20 cm wide. In the preferred embodiment, as seen in FIG. 2, the pockets 90 and 92 are separated by a seam 96. In FIG. 1, the seam 96 is omitted, leaving only a single pocket 90.

It is contemplated that at least one of the pockets 60, 68, 72, 80, 90 and 92 may have one of the temperature regulating elements 62 disposed inside of them at any given time. The location, dimensions, and design of the pockets 60, 68, 72, 80, 90 and 92 may vary from the above description to suit the application, provided that the pockets are constructed and arranged for allowing the heat or cooling from the temperature regulating element 62 to escape into the interior chamber 29 and this chamber is thus insulated from ambient temperature in the room, usually an operating room. Thus, the user will employ the type of temperature regulating element(s) 62 as needed to achieve a desired temperature within the interior chamber that has a perceived differential from the ambient temperature of the room. It is to be understood that this desired temperature will vary with the individual and the circumstances of the application.

The garment 10 is preferably made of a non-linting, temperature insulating textile which can withstand multiple industrial or hospital launderings. Advantageously, the preferred material maintains the temperature within the inside chamber 29. In the preferred embodiment, the pockets 60, 72, 68, 80, 90, and 92 of the garment 10 are made of polyester fabric, preferably mesh which allows for enhanced conductivity of the desired temperature in the inside chamber 29. However, in other embodiments, the pockets 60, 72, 68, 80, 90, 92, can be made of other textiles. The pockets 60, 72, 68, 80, 90, 92, are fastened to the garment 10 to withstand the weight of a one liter bag of IV fluid as well as repeated use of the pockets. In the preferred embodiment, the pockets 60, 72, 68, 80, 90, 92, are sewn to the inner or interior surfaces 56, 58, 54, respectively, of the front first panel 16, the second front panel 18, and the back panel 14, although alternate ways of fastening the pockets to the front first panel, the second front panel, and the back panel are envisioned.

In the preferred embodiment, the temperature regulating element 62 is a heating element, such as a chemical warming pack, warmed up bag of IV fluid or other elements that are remotely heated and placed into the pockets 60, 72, 68, 80, 90, 92, while warm. Advantageously, including a heating element allows the user to remain at a conformable temperature while working in a cold operating room. In other embodiments, similar benefits are obtained when the temperature regulating element 62 is a cooling element, including elements that are remotely cooled, chemical cooling packs, refrigerated bags of IV fluid or ice packs. The placement of, and amounts of the temperature regulating element 62 can be individualized to the needs of the wearer. One skilled in the art will appreciate that the temperature regulating element 62 is not limited to those listed and can be substituted with similar temperature regulating elements.

Figure 3A:
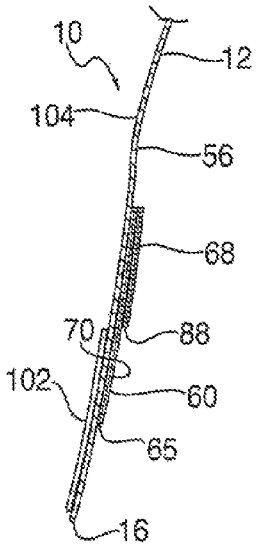
FIG. 3*a* is a cross-section taken along the line 3*a*-3*a* of FIG. 2 and in the direction generally indicated.
Figure 3B:
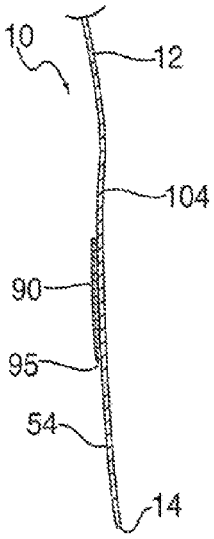
FIG. 3*b* is a cross-section taken along the line 3*b*-3*b* of FIG. 2 and in the direction generally indicated.
Figure 3C:
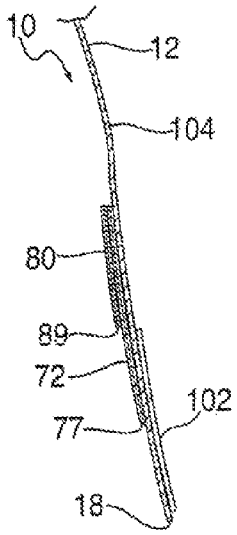
FIG. 3*c* is a cross-section taken along the line 3*c*-3*c* of FIG. 1 and in the direction generally indicated.

Referring now to FIGS. 3*a*, 3*c* and 4, at least one supplemental pocket 102 is fastened to an outer or exterior surface 104 of either or both of the first and second front panels 16, 18. As is known in the art, such supplemental pockets 102 can be used to hold a pen, pencil or other instrument needed by the wearer.

Figure 5:
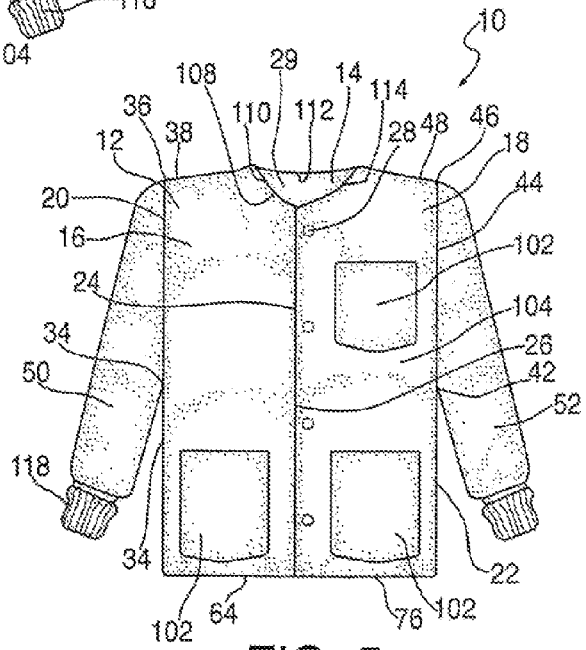
FIG. 5 is a front view of an alternate embodiment of the garment of FIG. 4.

Referring now to FIGS. 1, 2, and 4 the garment 10 preferably has a neck 108, formed by a top edge 110 of the first front panel 16, a top edge 112 of the back panel 14, and a top edge 114 of the second front panel 18. In the preferred embodiment, a collar 116, which will keep the wearer's neck warm, is affixed to the neck 108 of the garment 10. The garment 10 also preferably includes a cuff 118 affixed to each of the sleeves 50, 52. Note that the collar 116 is optional (FIG. 5). Advantageously, the cuffs 118 will keep the wrists of the wearer warm, and will serve to prevent heat from escaping into the room. The collar 116 and the cuffs 118 are preferably made of rib knit polyester, however other materials are contemplated.

Figure 6:
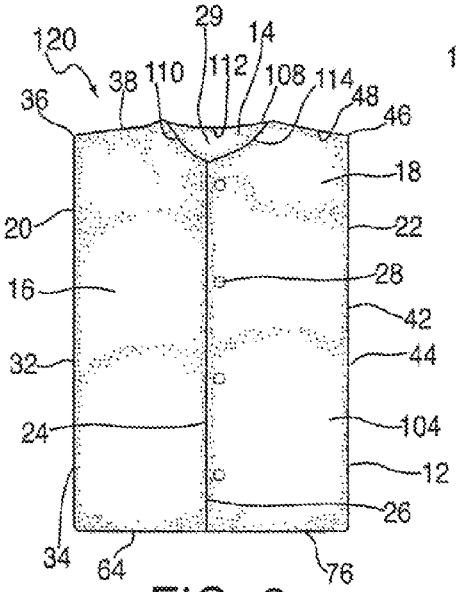
FIG. 6 is a front view of another alternate embodiment of the garment of FIG. 4.

Referring now to FIG. 6, an alternate embodiment of the garment is shown, generally designated 120. Components shared with the garment 10 are designated with identical reference numbers. The main distinction of the garment 120 is it does not have the first and second sleeves 50, 52. This embodiment is advantageous in that it helps keep the wearer's core warm or cool while being worn under a conventional warm up jacket or surgical gown. The garment 120 shown in FIG. 6 is preferably reversible such that the respective inner surfaces 56, 58, of the first 16 and second 18 front panels become an outer or exterior surface of the first 16 and second 18 front panels, respectively, and the inner surface 54 of the back panel 14 becomes an outer or exterior surface of the back panel 14. Reversing the garment 120 will place a nonfenestrated layer of material, that being the material of the body 12, between the wearer's skin and the temperature regulating element 62, particularly important if 62 is a cooling element. A temperature regulating element 62 for maintaining temperature range within the chamber between the vest and a conventional warm up jacket or between the vest and a surgical gown can be disposed into one or more pockets 60, 72, 68, 80, 90, 92.

Furthermore, the garments 10 and 120 are designed to meet guidelines for garments worn in hospital operating rooms as set forth by the American Association of PeriOperative Registered Nurses (AORN).

While a particular embodiment of the present temperature regulating garment has been described herein, it will be appreciated by those skilled in the art that changes and modifications may be made thereto without departing from the invention in its broader aspects and as set forth in the following claims.

What is claimed is:

1. A garment for regulating temperature, comprising:

a body including a back panel and at least one front panel made of a temperature insulating textile and partially joined along at least one common edge, said joined panels defining an inside chamber;

at least one pocket, fastened to an inner surface of at least one of said front panel and said back panel; and wherein said at least one pocket is configured for accommodating a temperature regulating element, and is a double pocket which includes at least one first pocket and at least one second pocket being fastened to said inner surface of said front panel, said second pocket being fastened to an outer surface of said first pocket or directly to said inner surface of said front panel such that said second pocket lies inside said first pocket, each said first and second pocket constructed and arranged for simultaneously accommodating said temperature regulating element, said second pocket having a length extending approximately half a length of said first pocket; and at least one temperature regulating element disposed inside one or more of said pockets, each said at least one temperature regulating element configured for maintaining a desired temperature within said inside chamber.

2. The garment of claim 1 further including at least one pocket fastened to the inner surface of said back panel approximately 20-25 cm from a bottom of said back panel to a bottom of the pocket so as to be placed over the wearer's lumbar region.

3. The garment of claim 1 wherein said first pocket and said second pocket being fastened to said inner surface of said front panel approximately 10-15 cm from a bottom of said first pocket to a bottom edge of said garment and approximately 4 cm from a lower front edge of said front panel of the garment to a side edge of said first pocket.

4. The garment of claim 1 having two arm holes, each defined by an end of a seam formed by joining said common edges of said front panel and said back panel, and at an end of said arm hole opposite said end of said seam by a shoulder seam formed by a junction of said front panel and said back panel.

5. The garment of claim 4 further including a first sleeve and a second sleeve affixed respectively to said first and said second arm holes.

6. The garment of claim 5 further including a cuff affixed to an end of each of said sleeves.

7. The garment of claim 6 further including said cuffs made of rib knit polyester.

8. The garment of claim 1 further including at least one supplemental pocket.

9. The garment of claim 8 further including said supplemental pockets fastened to the outer surface of said front panel.

10. The garment of claim 1 further including at least one of a neck or a collar.

11. The garment of claim 10 wherein at least one of said neck and said collar is made of rib-knit polyester.

12. The garment of claim 1 wherein at least one of said pockets is made of a material taken from the group consisting of polyester mesh, surgical fabric and polyester fabric.

13. The garment of claim 1 made of a material taken from the group consisting of polyester fabric and surgical fabric.

14. The garment of claim 1 made of a non-linting textile.

15. The garment of claim 1 being reversible such that said inner surface of said front panel becomes an outer surface of said front panel and said inner surface of said back panel becomes an outer surface of said back panel.

16. The garment of claim 1 wherein said body is made of a material configured for withstanding multiple industrial launderings.

17. A garment for regulating temperature, comprising:

a body including a back panel and at least one front panel made of a temperature insulating textile and partially joined along at least one common edge, said joined panels defining an inside chamber;

at least one pocket, fastened to an inner surface of at least one of said front panel and said back panel;

wherein the at least one pocket is configured for accommodating a temperature regulating element, and is a double pocket which includes at least one first pocket and at least one second pocket being fastened to said inner surface of said front panel, said second pocket being fastened to an outer surface of said first pocket or directly to said inner surface of said front panel such that said second pocket lies inside said first pocket, said second pocket having a length extending approximately half a length of said first pocket; and at least one temperature regulating element disposed inside one or more of said pockets, each said at least one temperature regulating element configured for maintaining a desired temperature within said inside chamber.

18. The garment of claim 17 wherein said at least one temperature regulating element is one of a heating element and a cooling element.

* * * * *